US010834507B2

(12) United States Patent
Wang et al.

(10) Patent No.: US 10,834,507 B2
(45) Date of Patent: Nov. 10, 2020

(54) AUDIO MODIFICATION SYSTEM AND METHOD THEREOF

(71) Applicant: HTC Corporation, Taoyuan (TW)

(72) Inventors: Yen-Chieh Wang, Taoyuan (TW); Yung-Ching Tseng, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 16/380,989

(22) Filed: Apr. 10, 2019

(65) Prior Publication Data

US 2019/0342665 A1 Nov. 7, 2019

Related U.S. Application Data

(60) Provisional application No. 62/666,116, filed on May 3, 2018.

(51) Int. Cl.

| | |
|---|---|
| ***H04R 5/04*** | (2006.01) |
| ***H04R 5/033*** | (2006.01) |
| ***H04S 7/00*** | (2006.01) |

(52) U.S. Cl.

CPC ..... *H04R 5/04* (2013.01); *H04R 5/033* (2013.01); *H04S 7/304* (2013.01); *H04S 2420/01* (2013.01)

(58) Field of Classification Search

CPC ..... H04R 5/033; H04R 5/04; H04S 1/005; H04S 2420/01; H04S 7/304

USPC ..... 381/58, 309

See application file for complete search history.

(56) References Cited

U.S. PATENT DOCUMENTS

| | | | | |
|---|---|---|---|---|
| 2006/0062398 | A1* | 3/2006 | McKee Cooper | G01S 11/14 381/58 |
| 2016/0345096 | A1* | 11/2016 | Lott | H04R 3/005 |
| 2017/0295446 | A1* | 10/2017 | Thagadur Shivappa | G06F 3/011 |
| 2017/0332186 | A1* | 11/2017 | Riggs | G06F 3/012 |
| 2018/0061449 | A1* | 3/2018 | Davila | H04R 3/005 |
| 2018/0139565 | A1* | 5/2018 | Norris | H04S 1/007 |
| 2018/0249274 | A1* | 8/2018 | Lyren | H04S 7/303 |
| 2019/0110137 | A1* | 4/2019 | Udesen | H04R 25/407 |
| 2019/0268682 | A1* | 8/2019 | Li | H04R 1/028 |

FOREIGN PATENT DOCUMENTS

WO 2007112756 A2 10/2007

OTHER PUBLICATIONS

Corresponding Taiwan office action dated May 13, 2020.

* cited by examiner

*Primary Examiner* — Paul Kim
*Assistant Examiner* — Friedrich Fahnert
(74) *Attorney, Agent, or Firm* — CKC & Partners Co., LLC

(57) ABSTRACT

An audio modification includes a signal transmitter, at least one signal receiver, a processor and an audio generator. The signal transmitter being disposed on a first device is configured to transmit a signal. The at least one signal receiver being disposed on a second device is configured to receive the signal. The processor is configured to determine a first distance between the first device and the second device according to a measuring indicator of the signal and to calculate a second distance that forms a head dimension of a user. The processor is further configured to apply the head dimension in a head related transfer function in order to modify audio information. The audio generator is configured to output a sound corresponding to the audio information.

14 Claims, 5 Drawing Sheets

AUDIO MODIFICATION SYSTEM AND METHOD THEREOF

CROSS-REFERENCE TO RELATED APPLICATION

This application claims priority to U.S. Provisional Application Ser. No. 62/666,116, filed on May 3, 2018, which is herein incorporated by reference.

BACKGROUND

Technical Field

Present disclosure relates to a computing system and method. More particularly, present disclosure relates to a computing system and method for audio output modification.

Description of Related Art

As one of the most important human senses, sounds are essential to user experience in simulated environment applications. Though head related transfer function (HRTF) is known in the field, it is still difficult to dynamically measure the shape of user's head.

SUMMARY

Some aspects of present disclosure are to provide an audio modification system. The audio modification system comprises a signal transmitter, at least one signal receiver, a processor and at least one audio generator. The signal transmitter is disposed on a first device and being configured to transmit a signal. The at least one signal receiver is disposed on a second device and being configured to receive the signal. The processor is electrically coupled to the signal transmitter and the at least one signal receiver. The processor is configured to determine a first distance between the first device and the second device according to a measuring indicator of the signal received by the at least one signal receiver. The processor is further configured to calculate a second distance that forms a head dimension of a user according to the first distance and to apply the head dimension in a head related transfer function in order to modify audio information. The at least one audio generator is electrically coupled to the processor and being configured to output a sound corresponding to the audio information.

Some aspects of disclosure are to provide audio modification method. The method comprises following steps: transmitting, by a signal transmitter disposed on a first device, a signal; receiving, by at least one signal receiver disposed on a second device, the signal; determining, by a processor, a first distance between the first device and the second device according to a measuring indicator of the signal received by the at least one signal receiver; calculating, by the processor, a second distance that forms a head dimension of a user according to the first distance; applying, by the processor, the head dimension in a head related transfer function in order to modify audio information; and outputting, by at least one audio generator, a sound corresponding to the audio information.

It is to be understood that both the foregoing general description and the following detailed description are by examples, and are intended to provide further explanation of the disclosure as claimed.

BRIEF DESCRIPTION OF THE DRAWINGS

Present disclosure can be more fully understood by reading the following detailed description of the embodiment, with reference made to the accompanying drawings as follows.

DETAILED DESCRIPTION

Figure 1:
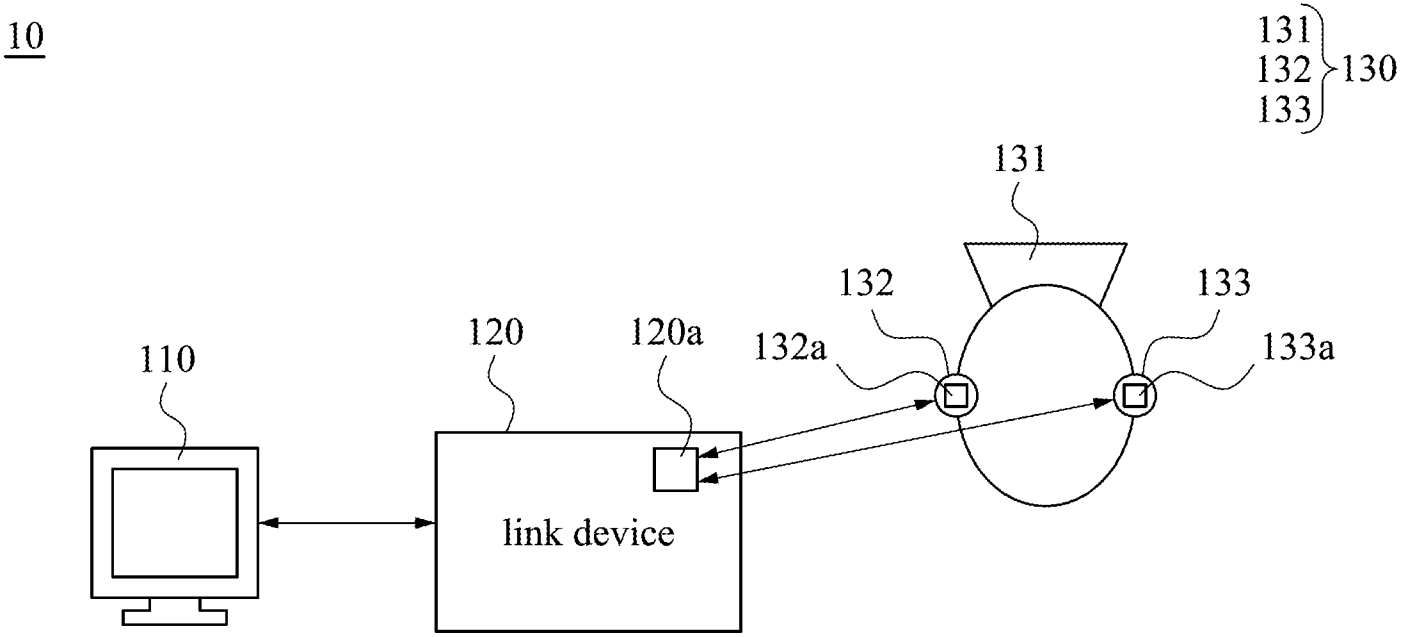
FIG. 1 is a schematic diagram of an audio modification system according to some embodiments of present disclosure.

Reference will now be made in detail to the present embodiments of the disclosure, examples of which are illustrated in the accompanying drawings. Wherever possible, the same reference numbers are used in the drawings and the description to refer to the same or like parts.

The terms used in this specification generally have their ordinary meanings in the art and in the specific context where each term is used. The use of examples in this specification, including examples of any terms discussed herein, is illustrative only, and in no way limits the scope and meaning of the disclosure or of any exemplified term. Likewise, the present disclosure is not limited to various embodiments given in this specification.

As used herein, the terms "comprising," "including," "having," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present disclosure. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

In the following description and claims, the terms "coupled" and "connected", along with their derivatives, may be used. In particular embodiments, "connected" and "coupled" may be used to indicate that two or more elements are in direct physical or electrical contact with each other, or may also mean that two or more elements may be in indirect contact with each other. "Coupled" and "connected" may still be used to indicate that two or more elements cooperate or interact with each other.

FIG. 1 is a schematic diagram of an audio modification system according to some embodiments of present disclosure. As shown in FIG. 1, in some embodiments, the audio modification system 10 includes a host computer 110, a link device 120 and a wearable set 130. The wearable set 130 includes a head mounted display 131, a first earphone 132 and a second earphone 133. As shown in the figure, the top view shows a case that the wearable set 130 is settled on a user's head. In the figure, the head mounted display 131 is illustrated as a box-shaped device settled in front of the face of the user. In the figure, the first earphone 132 and the second earphone 133 are illustrated as two circle-shaped devices settled around two lateral sides of the user's head. In some embodiments, the first earphone 132 and the second earphone 133 are a pair of earphones adapting to a left ear and a right ear of the user, respectively.

In some embodiments, the host computer 110 and the wearable set 130 may be electrically/communicatively coupled with each other via the link device 120. That is, the link device 120 may be connected to the host computer 110, in order to act as a signal transceiver of the host computer 110. In one direction, a signal transceiver 120*a* of the link device 120 may modulate information from the host computer 110 into signals and send the signals to the wearable set 130. In another direction, the signal transceiver 120*a* may receive signals from the wearable set 130 and send information carried by the signals to the host computer 110. In this configuration, a bidirectional information exchange between the host computer 110 and the wearable set 130 is established.

More specifically, in some embodiments, the first earphone 132 is configured with a signal transceiver 132*a* to receive/send signals from/to the signal transceiver 120*a* and the second earphone 133 is configured with a signal transceiver 133*a* to receive/send signals from/to the signal transceiver 120*a*. In some embodiments, signal transmission between the signal transceiver 120*a*, the signal transceiver 132*a* and the signal transceiver 133*a* are based on some radio frequency standards, such as WiFi, etc. In some embodiments, the signal transceiver 132*a* and the signal transceiver 133*a* are parts of a communication module of the wearable set 130, mainly used to receive signals carrying audio information from the host computer 110 via the link device 120. In this case, audio generators in the first earphone 132 and the second earphone 133 may output sounds corresponding to the received audio information.

In some embodiments, the host computer 110 may be a specific computer containing processors and memories associated to provide a simulated environment experience with sound effects to the user. More specifically, at least one processor of the host computer 110 may access instructions stored in at least one memory of the host computer 110 to execute a simulated environment process so that information regarding the simulated environment may be sent to the wearable set 130 and be presented by the wearable set 130. In some embodiments, the head mounted display 131 may be configured to display video contents of the simulated environment information to the user. In some embodiments, the first earphone 132 and the second earphone 133 may be configured to display audio contents of the simulated environment information to the user. It is noted that, in some embodiments, said simulated environment may be at least one of an augmented reality environment, a virtual reality environment and a mixed reality environment.

It is noted that, in some embodiments, indicators of the signal transmission between the signal transceiver 120*a* and the signal transceiver 132*a*/133*a* may be measured in order to modify the audio information being sent to the first earphone 132 or the second earphone 133. In some embodiments, the signal transceiver 132*a* may measure a received signal strength indicator (RSSI) of the signals sending from the signal transceiver 120*a*. The measured RSSI may be reported to the processor of the host computer 110 via the link device 120. According to the measured RSSI, the processor may calculate a distance from the signal transceiver 120*a* to the signal transceiver 132*a*, which is also the distance from the link device 120 to the first earphone 132. In the embodiments, higher value of the RSSI represents a shorter distance from the signal transceiver 120*a* to the signal transceiver 132*a*, and vice versa. Similarly, RSSI of the signals received by the signal transceiver 133*a* may be used to calculate a distance from the signal transceiver 120*a* to the signal transceiver 133*a*.

In some embodiments, a latency of the signal transmission may be measured by the processor of the host computer 110. It is noted that the signal transceiver 132*a* and the signal transceiver 133*a* are disposed at different laterals of the user's head. Therefore, there would be a time difference from the latency of the signal transceiver 132*a* receiving the signal to the latency of the signal transceiver 133*a* receiving the signal. According to the latencies, distance from the signal transceiver 120*a* to the signal transceiver 132*a* (and the signal transceiver 133*a*) may be obtained.

In some embodiments, the processor may calculate a distance between the left ear and the right ear of the user according to the distance from the signal transceiver 120*a* to the signal transceiver 132*a* and the distance from the signal transceiver 120*a* to the signal transceiver 133*a*. With the distance between two ears of the user, the processor may gain a head dimension (i.e. a head shape) of the user. In some embodiments, the processor may apply the head dimension in a head related transfer function (HRTF) process in order to modify the audio information of the simulated environment. It is noted that the HRTF process may be established according to known HRTF algorithms. The HRTF process may be used to adjust parameters (e.g. volume or frequency, etc.) of the predetermined audio information to adapt to the head shape of the user.

In some embodiments, the modified audio information may be sent to the first earphone 132 and the second earphone 133 so that the first earphone 132 and the second earphone 133 may play sounds with three dimensional effects corresponding to the modified audio information. The sounds played by the first earphone 132 and the second earphone 133 may simulate an effect to the user that the sounds are sourcing from a predetermined object/place in the simulated environment.

Figure 2:
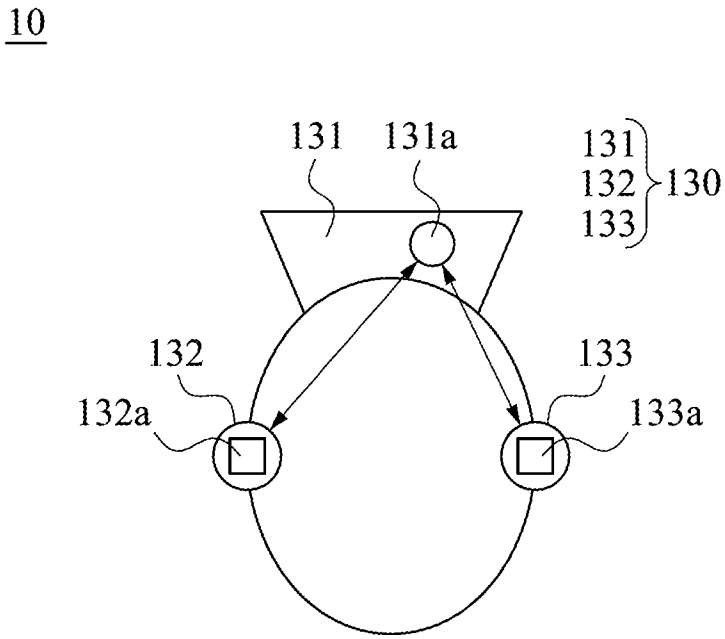
FIG. 2 is a schematic diagram of an audio modification system according to some embodiments of present disclosure.

FIG. 2 is a schematic diagram of an audio modification system according to some embodiments of present disclosure. In some embodiments of FIG. 2, the audio modification system 10 includes the wearable set 130. The wearable set 130 includes the head mounted display 131, the first earphone 132 and the second earphone 133, similar to the embodiments of FIG. 1. However, in some embodiments of FIG. 2, the head mounted display 131 is configured with a signal transceiver 131*a*. In some embodiments, the signal transceiver 131*a* of the head mounted display 131 may receive/send signals from/to the signal transceiver 132*a* and receive/send signals from/to the signal transceiver 133*a*.

In some embodiments, the wearable set 130 may be configured with at least one processor (not shown) and at least one memory (not shown), in order provide a simulated environment experience with sound effects to the user. In some embodiments, the at least one processor and the at least one memory may be settled on at least one of the head mounted display 131, the first earphone 132, or the second earphone 133. The at least one processor may access instructions stored in the at least one memory, in order to execute a simulated environment process so that information regarding the simulated environment may be presented by the wearable set 130. In some embodiments, the head mounted display 131 may be configured to display video contents of the simulated environment information to the user, and the first earphone 132 and the second earphone 133 may be configured to display audio contents of the simulated environment information to the user.

Similar to the embodiments of FIG. 1, when the signal transceiver 131*a* sends radio frequency signals to the signal transceiver 132*a*/133*a*, the at least one processor of the wearable set 130 may measure indicators of the signal transmission between the signal transceiver 131*a* and the signal transceiver 132*a*/133*a* so as to modify the audio information being sent to the first earphone 132 or the second earphone 133. In some embodiments, the measured indicators may be a RSSI of the signals received by the signal transceiver 132*a*/133*a* or a latency of the signal transmission. According to the measured indicators, distances between the signal transceiver 131*a* and the signal transceiver 132*a*/133*a* may be obtained. In this case, the distance between the left ear and the right ear of the user may be gained as well. The processor may calculate the user's head dimension according to the distance between the user's ears and further apply the head dimension in the HRTF process. Through the HRTF process, the audio information being sent to the first earphone 132 and the second earphone 133 may be modified. The sounds corresponding to the modified audio information making the user feels like that the sounds are actually sourcing from a predetermined object/place in the simulated environment.

Figure 3:
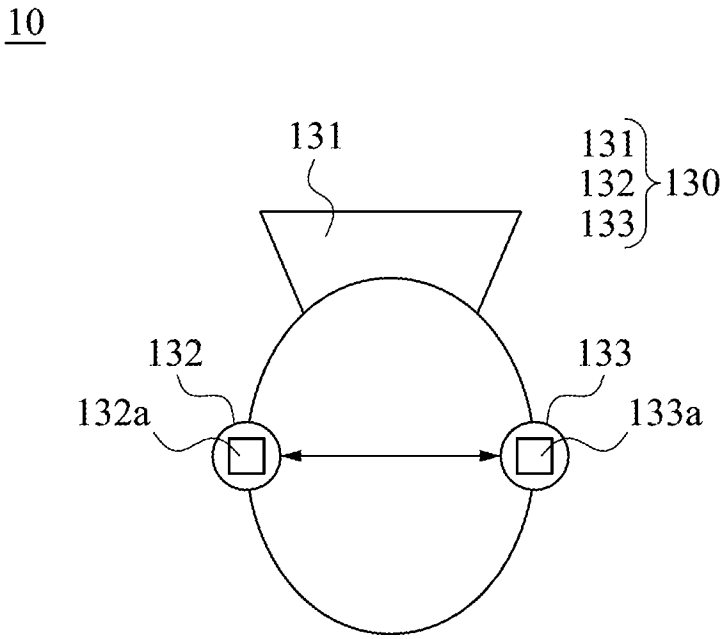
FIG. 3 is a schematic diagram of an audio modification system according to some embodiments of present disclosure.

FIG. 3 is a schematic diagram of an audio modification system according to some embodiments of present disclosure. In some embodiments of FIG. 3, the wearable set 130 includes the head mounted display 131, the first earphone 132 and the second earphone 133, similar to the embodiments of FIG. 1 and FIG. 2. A difference is that, in some embodiments of FIG. 3, the signals are transmitted between the signal transceiver 132*a* of the first earphone 132 and the signal transceiver 133*a* of the second earphone 133.

Similar to the embodiments of FIG. 2, when the signal transceiver 132*a* sends radio frequency signals to the signal 133*a* (or in an opposite way), a processor of the wearable set 130 may receive indicators of the signal transmission, such as RSSI and latencies, between the signal transceiver 132*a* and the signal transceiver 133*a*. According to the measured indicators, distances between the signal transceiver 132*a* and the signal transceiver 133*a* (i.e. also the distance between two ears of the user) may be obtained. In this case, the processor may calculate the user's head dimension according to the distance between the user's ears and apply the head dimension in the HRTF process in order to modify the audio information being sent to the first earphone 132 and the second earphone 133. The sounds played according to the modified audio information may simulate an effect to the user that the sounds are sourcing from a predetermined object/place in the simulated environment.

Figure 4:
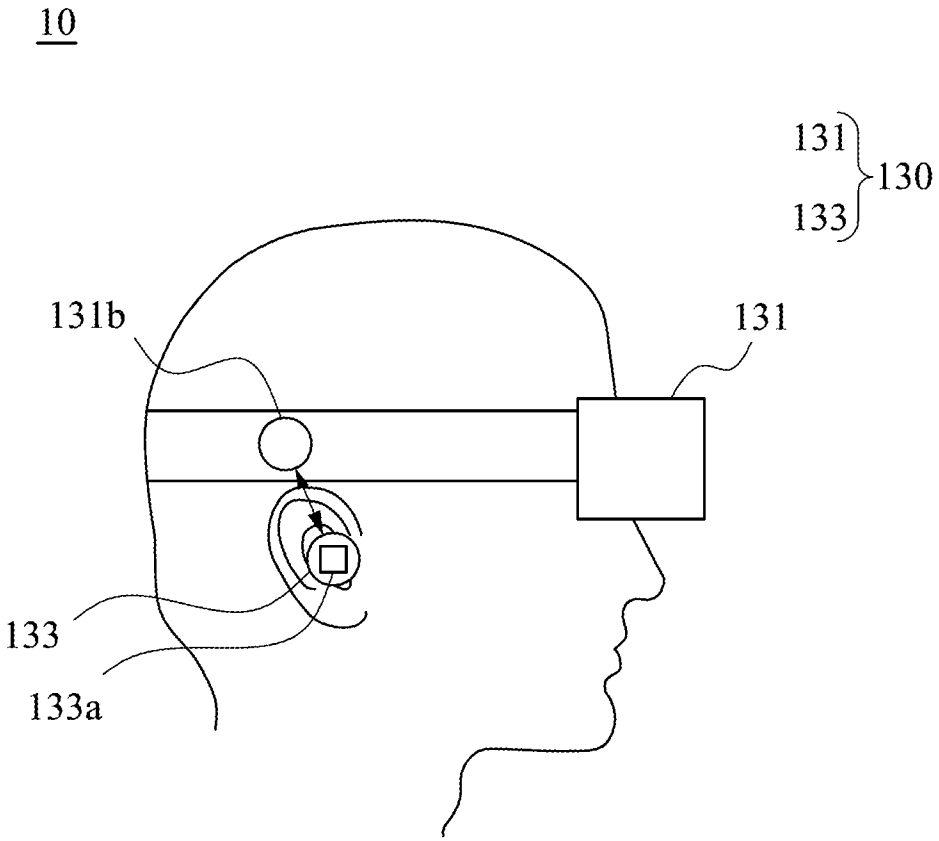
FIG. 4 is a schematic diagram of an audio modification system according to some embodiments of present disclosure.

FIG. 4 is a schematic diagram of an audio modification system according to some embodiments of present disclosure. In some embodiments of FIG. 2, the audio modification system 10 includes the wearable set 130. As shown in the lateral view, the wearable set 130 includes the head mounted display 131 and the second earphone 133, similar to the embodiments of FIG. 1 and FIG. 2 (another earphone may not be seen in this view). However, in some embodiments, the head mounted display 131 is configured with a signal transceiver 131*b*. As shown in FIG. 4, the signal transceiver 131*b* may be settled on a band of the head mounted display 131. It is noted that, in some embodiments, the band may be made by elastic materials or adjustable structures in order to fit a size of the user's head.

In some embodiments, the signal transceiver 131*b* of the head mounted display 131 may receive/send signals from/to the signal transceiver 133*a* of the second earphone 133. In some embodiments, the signal transceiver 131*b* and the signal transceiver 133*a* are both near-field magnetic induction signal transceiver. In this case, signal transmissions between the signal transceiver 131*b* and the signal transceiver 133*a* are based on near-field magnetic induction transmission standards.

In some embodiments, the at least one processor and the at least one memory of the wearable set 130 may be settled on at least one of the head mounted display 131 or the second earphone 133. Similar to the above embodiments, in this example the second earphone 133 (and another earphone not shown in the figure) may play audio contents of the simulated environment in a simulated environment process.

Similar to the embodiments of FIG. 1 and FIG. 2, when the signal transceiver 131*b* sends signals to the signal transceiver 133*a* (and signal transceiver attached on another earphone at another side), the at least one processor of the wearable set 130 may receive indicators (e.g. RSSI or latency) of the signal transmission between the signal transceiver 131*a* and the signal transceiver 133*a* (and another transceiver attached on another earphone), in order to calculate the distances between these signal transceivers. According to the calculated distances, the at least one processor may get the distance between two ears of the user then obtain the user's head dimension. A HRTF process according to the user's head dimension may be executed to modify the audio information before sending to earphones. It is noted that the sounds played according to the modified audio information may simulate an effect to the user that the sounds are sourcing from predetermined object/place in the simulated environment.

Figure 5:
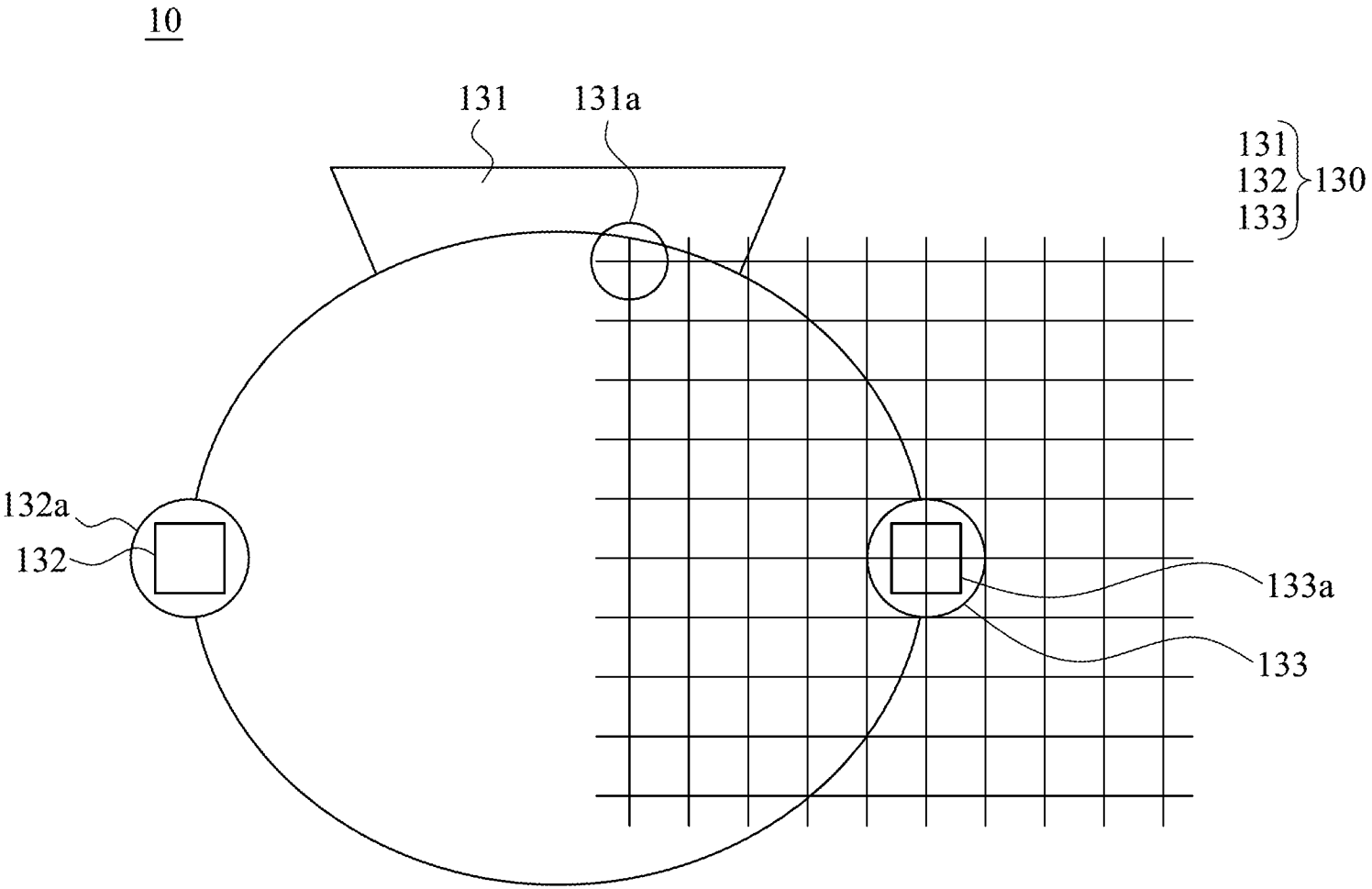
FIG. 5 is a schematic diagram of an audio modification system according to some embodiments of present disclosure.

FIG. 5 is a schematic diagram of an audio modification system according to some embodiments of present disclosure. The system configuration shown in FIG. 5 is basically the same as the system configuration in the embodiments of FIG. 2. In some embodiments, the signal transceiver 131*a* settled on the head mounted display 131 may send radio frequency signals to the signal transceiver 132*a* of the first earphone 132 and the signal transceiver 133*a* of the second earphone 133.

In FIG. 5, a coordinate diagram from top view of the wearable set 130 is illustrated. The diagram shows that, in some embodiments, received signal strength indicator (RSSI) distribution for the potential receivers positioned at these coordinates to receive signals from the signal transceiver 131*a* may be gathered as a lookup table. Each point in the coordinate system shown in the diagram may correspond to a value that represents a received signal strength indicator. The lookup table may be used in the distance determination mentioned in foregoing embodiments.

It is noted that, in some embodiments, a longer distance between the signal transceiver 131*a* and the signal transceiver 133*a* reflects a larger size of the user's head, and vice versa. In the lookup table, a longer distance corresponds to a lower value of RSSI and a shorter distance corresponds to a higher value of RSSI. Therefore, with the lookup table, the processor of the wearable set 130 may properly determine the distance from the signal transceiver 131*a* to the signal transceiver 133*a* based on values of the measured RSSI. However, it is understood that the lookup table is for exemplary purpose but not to limit the scope of present disclosure, other alternatives are possible.

It is understood that, in foregoing embodiments, the term "transceiver" is used to describe a unit functioning as both signal transmitter and signal receiver. Therefore, each of the transceivers described in these embodiments may be implemented with an integration device having a signal transmitter circuit and a signal receiver circuit. The signal transmitter circuit is configured to send out signals, and the signal receiver circuit is configured to receive signals. Various types of the transmitter circuit and those of the receiver circuit to implement the signal transceivers discussed herein are within the contemplated scope of the present disclosure.

Figure 6:
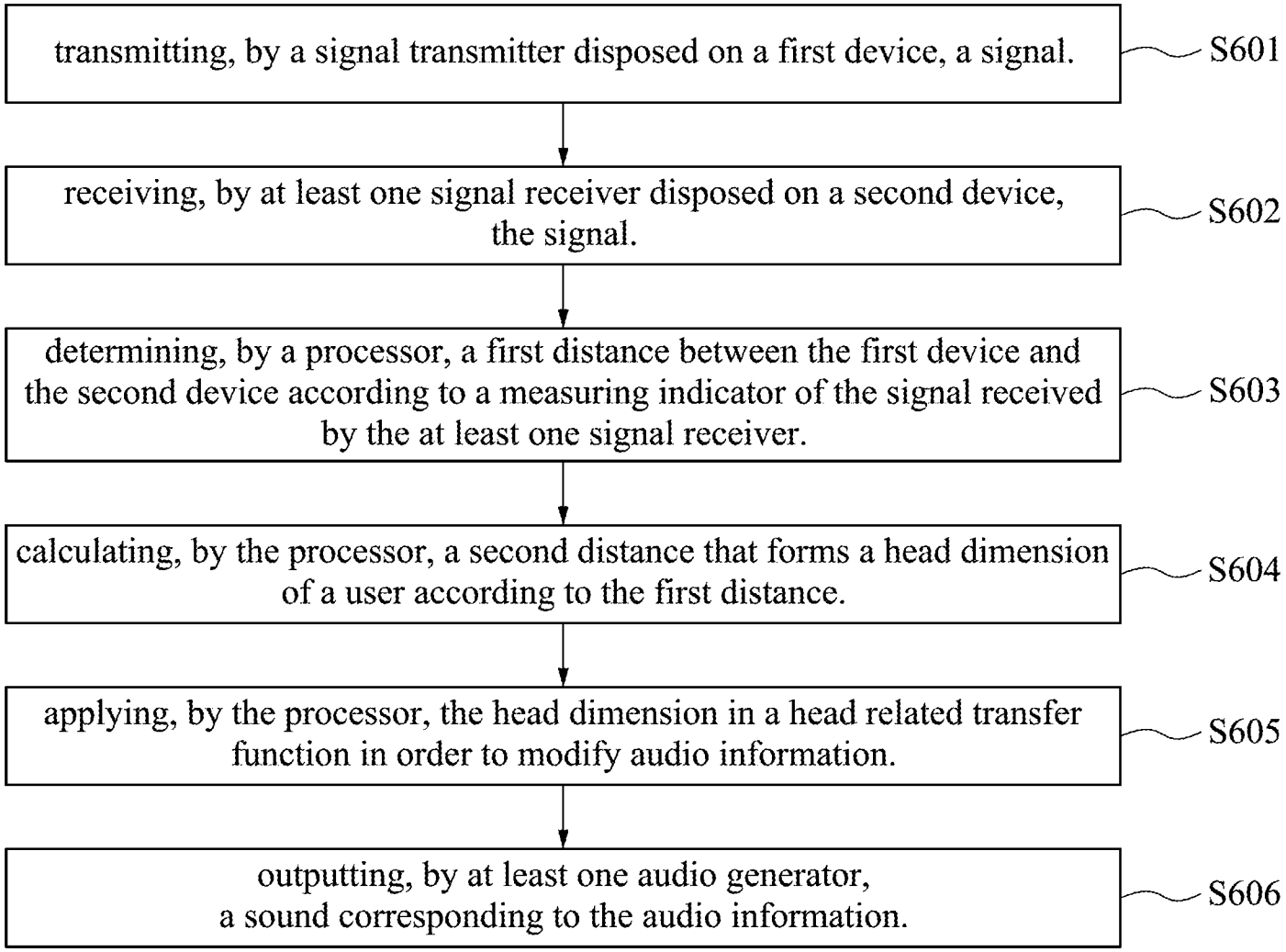
FIG. 6 is a flow chart of an audio modification method according to some embodiments of present disclosure.

Reference is made to FIG. 6. The FIG. 6 is a flow chart of an audio modification method according to some embodiments of present disclosure. In the embodiment, the audio modification method 600 is executed by the audio modification systems mentioned in the foregoing embodiments of FIG. 1-5, the references to the embodiments are herein incorporated. In the embodiment, the steps of the audio modification method 600 will be listed and explained in detail in following segments.

Step S601: transmitting, by a signal transmitter disposed on a first device, a signal.

In some embodiments of FIG. 1, the link device 120 connected to the host computer 110 may transmit signals to the signal transceiver 132*a* of the first earphone 132 and the signal transceiver 133*a* of the second earphone 133. In some embodiments of FIG. 2 and FIG. 5, the signal transceiver 131*a* of the head mounted display 131 may transmit signals to the signal transceiver 132*a* of the first earphone 132 and the signal transceiver 133*a* of the second earphone 133. In some embodiments of FIG. 3, the signal transceiver 132*a* of the first earphone 132 may transmit signals to the signal transceiver 133*a* of the second earphone 133. In some embodiments of FIG. 4, the signal transceiver 131*b* of the head mounted display 131 may transmit signals to the signal transceiver 133*a* of the second earphone 133 (also to the signal transceiver on the earphone at another side).

Step S602: receiving, by at least one signal receiver disposed on a second device, the signal.

In some embodiments of FIG. 1, the signal transceiver 132*a* and the signal transceiver 133*a* may receive the signals from the link device 120. In some embodiments of FIG. 2 and FIG. 5, the signal transceiver 132*a* and/or the signal transceiver 133*a* may receive the signals from the signal transceiver 131*a*. In some embodiments of FIG. 3, the signal transceiver 133*a* may receive the signals from the signal transceiver 132*a*. In some embodiments of FIG. 4, the signal transceiver 133*a* (also to the signal transceiver on the earphone at another side) may receive the signals from the signal transceiver 131*b*.

Step S603: determining, by a processor, a first distance between the first device and the second device according to a measuring indicator of the signal received by the at least one signal receiver.

In some embodiments, the processor of the wearable set 130 may determine the distances from the signal transmitter to the signal receiver. For example, in the embodiments of FIG. 2 and FIG. 5, the distance from the signal transceiver 131*a* to the signal transceivers 132*a*/133*a* may be determined according to RSSI distributions around the signal transceiver 131*a*. As shown in the embodiments of FIG. 5, the lookup table may be used to determine said distances between the signal transceiver 131*a* and the signal transceivers 132*a*/133*a*.

Step S604: calculating, by the processor, a second distance that forms a head dimension of a user according to the first distance.

As mentioned in foregoing embodiments, the processor of the wearable set 130 (or the processor of the host computer 110) may calculate the distance between the left ear and the right ear of the user according to the distances between the signal transmitter and the signal receiver. For instance, in the embodiments of FIG. 3, the distance between the signal transceiver 132*a* of the first earphone 132 and the signal transceiver 133*a* of the second earphone 133 may be directly used as the distance between two ears of the user.

Step S605: applying, by the processor, the head dimension in a head related transfer function in order to modify audio information.

In some embodiments, with the distance between two ears of the user, the processor of the wearable set 130 (or the processor of the host computer 110) may gain the dimension of the user's head (i.e. the substantial shape of the user). The dimension of the user's head may be inputted into algorithms of the head related transfer function (HRTF) process to get parameters that may be used to tune the audio information of the simulated environment. In some embodiments, the processor of the wearable set 130 (or the processor of the host computer 110) may modify the audio information according to these parameters gained in the related transfer function process.

Step S606: outputting, by at least one audio generator, a sound corresponding to the audio information.

In some embodiments, the modified audio information may be delivered to the first earphone 132 and/or the second earphone 133. The audio generators in the first earphone 132 and/or the second earphone 133 may output sounds corresponding to the modified audio information to the user. With the video contents of the simulated environment presented by the head mounted display 131, the user may experience an effect that the sounds are sourcing from a specific place in the simulated environment.

In some embodiments, compensations can be made to the modified audio information when the user's acceleration is measured. In some embodiments, as mentioned, the processor (i.e. the processor of the host computer 110) may get the distances between the signal transceivers (i.e. the signal transceiver 120*a* and the signal transceivers 132*a*/133*a*). According to variations in these distances, the processor may calculate an acceleration of the user. When such acceleration of user is measured, the processor may establish a Doppler-effect compensation process to the modified audio information. In some embodiments, the wearable set 130 may be configured with an inertial measurement unit to detect the acceleration of the user. In these cases, the user may hear the sounds according to his/her acceleration. However, it is understood that the embodiments of audio compensations are exemplary cases but not intended to limit the scope of present disclosure.

In foregoing embodiments, the audio modification system 10 may execute the audio modification method 600 to provide modified sounds adapting to head dimensions of different users. The modified sounds may bring a deeply immersive simulated environment experience to the users.

Although the present disclosure has been described in considerable detail with reference to certain embodiments thereof, other embodiments are possible. Therefore, the spirit and scope of the appended claims should not be limited to the description of the embodiments contained herein.

Various functional components or blocks have been described herein. As will be appreciated by persons skilled in the art, in some embodiments, the functional blocks will preferably be implemented through circuits (either dedicated circuits, or general purpose circuits, which operate under the control of one or more processors and coded instructions), which will typically comprise transistors or other circuit elements that are configured in such a way as to control the operation of the circuity in accordance with the functions and operations described herein. As will be further appreciated, the specific structure or interconnections of the circuit elements will typically be determined by a compiler, such as a register transfer language (RTL) compiler. RTL compilers operate upon scripts that closely resemble assembly language code, to compile the script into a form that is used for the layout or fabrication of the ultimate circuitry. Indeed, RTL is well known for its role and use in the facilitation of the design process of electronic and digital systems.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An audio modification system, comprising:

a signal transmitter configured to transmit a radio signal;

first and second signal receivers, disposed on a pair of earphones respectively, the first and second signal receivers configured to receive the radio signal;

a processor, electrically coupled to the signal transmitter and the first and second signal receivers, the processor configured to determine a first distance between the signal transmitter and the first signal receiver according to a measuring indicator of the radio signal received by the first signal receiver;

determine a second distance between the signal transmitter and the second signal receiver according to the measuring indicator of the radio signal received by the second signal receiver; and calculate a third distance between two ears of a user that forms a head dimension of the user according to the first distance and the second distance, and to apply the head dimension in a head related transfer function in order to modify audio information; and at least one audio generator disposed on the pair of earphones, electrically coupled to the processor, the at least one audio generator configured to output a sound corresponding to the audio information.

2. The audio modification system of claim 1, wherein the processor is configured to determine the second distance according a lookup table of distribution of the measuring indicator.

3. The audio modification system of claim 1, wherein the signal transmitter is disposed at a head mounted display.

4. The audio modification system of claim 1, wherein the signal transmitter is disposed at a link device connected to a host computer.

5. The audio modification system of claim 1, wherein the signal transmitter is a near-field magnetic induction signal transmitter, and the two signal receivers are near-field magnetic induction signal receivers.

6. The audio modification system of claim 1, wherein the measuring indicator is a received signal strength indicator.

7. The audio modification system of claim 1, wherein the measuring indicator is a signal latency indicator.

8. An audio modification method, comprising:

transmitting, by a signal transmitter, a radio signal;

receiving, by two signal receivers disposed on a pair of earphones respectively, the radio signal;

determining, by a processor, a first distance between the signal transmitter and the two signal receivers according to a measuring indicator of the radio signal received by the two signal receivers respectively;

calculating, by the processor, a second distance between two ears of a user that forms a head dimension of the user according to the first distance;

applying, by the processor, the head dimension in a head related transfer function in order to modify audio information; and outputting, by at least one audio generator disposed on the pair of earphones, a sound corresponding to the audio information.

9. The audio modification method of claim 8, wherein the second distance is determined according a lookup table of distribution of the measuring indicator.

10. The audio modification method of claim 8, wherein the signal transmitter is disposed at a head mounted display.

11. The audio modification method of claim 8, wherein the signal transmitter is disposed at a link device connected to a host computer.

12. The audio modification method of claim 8, wherein the signal transmitter is a near-field magnetic induction signal transmitter and the two signal receivers are near-field magnetic induction signal receivers.

13. The audio modification method of claim 8, wherein the measuring indicator is a received signal strength indicator.

14. The audio modification method of claim 8, wherein the measuring indicator is a signal latency indicator.

* * * * *